US008058945B2

(12) United States Patent
Wada et al.

(10) Patent No.: US 8,058,945 B2
(45) Date of Patent: Nov. 15, 2011

(54) FERRITE MAGNET DEVICE, NONRECIPROCAL CIRCUIT DEVICE, AND COMPOSITE ELECTRONIC COMPONENT

(75) Inventors: Takaya Wada, Yasu (JP); Atsushi Konishi, Rittou (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 89 days.

(21) Appl. No.: 12/484,304

(22) Filed: Jun. 15, 2009

(65) Prior Publication Data

US 2009/0315656 A1 Dec. 24, 2009

(30) Foreign Application Priority Data

Jun. 24, 2008 (JP) ..... 2008-164793

(51) Int. Cl.
*H01P 1/36* (2006.01)
*H01P 1/32* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 6,710,671 B1 * 3/2004 Tanaka ..... 333/1.1
7,611,927 B2 * 11/2009 Liao et al. ..... 438/140
2002/0079981 A1 6/2002 Tanaka
2003/0006855 A1 1/2003 Yoneda

FOREIGN PATENT DOCUMENTS

| | | | |
|---|---|---|---|
| JP | 2002-076711 | A | 3/2002 |
| JP | 2002-299912 | A | 10/2002 |
| JP | 2004-364102 | A | 12/2004 |
| JP | 3649162 | B2 | 5/2005 |
| JP | 2006-311455 | A | 11/2006 |
| JP | 2007-208943 | A | 8/2007 |
| JP | 2010-010804 | A | 1/2010 |

OTHER PUBLICATIONS

Official Communication issued in corresponding Japanese Patent Application No. 2008-164793, mailed on Apr. 13, 2010.

* cited by examiner

*Primary Examiner* — Stephen Jones
(74) *Attorney, Agent, or Firm* — Keating & Bennett, LLP

(57) ABSTRACT

A ferrite magnet device, a nonreciprocal circuit device, and a composite electronic component are provided. The ferrite magnet device includes a ferrite element having a plurality of central electrodes arranged to intersect one another in an electrically insulated state, and a pair of permanent magnets fixed to both main surfaces of the ferrite element so as to apply a direct current magnetic field to the ferrite element. The central electrodes are made of metal foils provided on both main surfaces of the ferrite element, with adhesive layers therebetween. Electrodes provided on the upper and lower surfaces of the ferrite element are formed by plating in through holes.

5 Claims, 14 Drawing Sheets

STEP 7
FORM THROUGH HOLES

STEP 8
FORM ELECTRODES

STEP 9
FORM ADHESIVE LAYER

STEP 10
FORM ELECTRODE LAYER

STEP 11
FORM INSULATOR LAYER

STEP 12
FORM ELECTRODE LAYER

STEP 13
FORM ELECTRODES

STEP 14
FORM ADHESIVE LAYER

STEP 15
BOND MAGNET

FERRITE MAGNET DEVICE, NONRECIPROCAL CIRCUIT DEVICE, AND COMPOSITE ELECTRONIC COMPONENT

BACKGROUND OF THE INVENTION

1. Field of the Invention

The present invention relates to a ferrite magnet device, a nonreciprocal circuit device including the ferrite magnet device, and a composite electronic component including the nonreciprocal circuit device. The nonreciprocal circuit device may be an isolator or a circulator, for example, used in a microwave band.

2. Description of the Related Art

Typical nonreciprocal circuit devices, such as isolators or circulators, have a characteristic in which a signal is transmitted in a predetermined specific direction and not transmitted in the reverse direction. To utilize this characteristic, an isolator, for example, is used in the transmitter circuit unit of a mobile communication apparatus such as a vehicle telephone or a cellular phone.

Usually, such a nonreciprocal circuit device includes a ferrite magnet device including a ferrite element having central electrodes provided thereon and a permanent magnet arranged to apply a direct current (DC) magnetic field to the ferrite element, and a predetermined matching circuit device including a resistor and a capacitor. A module, such as a composite electronic component having a plurality of nonreciprocal circuit devices or a composite electronic component including a nonreciprocal circuit device and a power amplifier device, is also currently available.

Various nonreciprocal circuit devices have been proposed in Japanese Unexamined Patent Application Publication No. 2002-299912, Japanese Patent No. 3649162, Japanese Unexamined Patent Application Publication No. 2007-208943, for example. The nonreciprocal circuit devices described in Japanese Unexamined Patent Application Publication No. 2002-299912 and Japanese Patent No. 3649162 require complex assemblies, which cause variations in characteristics due to deviations in the assembly, since the permanent magnet and ferrite element having central electrodes are not combined. The nonreciprocal circuit device described in Japanese Patent No. 3649162, in particular, has a problem in which the central electrodes that are made of a photosensitive conductor paste undergo shrinkage after sintering, and thus, the precision is limited due to variation in the degree of shrinkage.

In the nonreciprocal circuit device described in Japanese Unexamined Patent Application Publication No. 2007-208943, the ferrite element including central electrodes is supported by a pair of permanent magnets so as to be combined with the permanent magnets. Thus, the problem of assembly deviations is solved due to this simple configuration. However, the problem of variation in the degree of shrinkage has not been solved since the central electrodes require sintering.

SUMMARY OF THE INVENTION

To overcome the problems described above, preferred embodiments of the present invention provide a ferrite magnet device, a nonreciprocal circuit device, and a composite electronic component that can prevent manufacturing errors caused by sintering.

According to a preferred embodiment of the present invention, a ferrite magnet device includes a ferrite element having a plurality of central electrodes arranged to intersect with one another in an electrically insulated state, and a permanent magnet fixed to a main surface of the ferrite element so as to apply a direct current magnetic field to the ferrite element. The central electrodes are made of metal foils that are provided on both main surfaces of the ferrite element with adhesive layers therebetween, and each of the central electrodes conducts through a corresponding electrode provided by plating on a surface of the ferrite element that is perpendicular or substantially perpendicular to the main surface of the ferrite element.

In the ferrite magnet device, the central electrodes are preferably made of metal foils that are provided on both main surfaces of the ferrite element, and electrodes arranged to electrically connect the central electrodes on both surfaces are provided by plating. Thus, no sintering is required, and no shrinkage error due to sintering occurs.

According to a preferred embodiment of the present invention, a nonreciprocal circuit device includes the ferrite magnet device.

According to a preferred embodiment of the present invention, a composite electronic component includes the nonreciprocal circuit device.

According to preferred embodiments of the present invention, the process for manufacturing a ferrite magnet device does not requires a sintering step. Therefore, the degradation of precision due to a shrinkage error is prevented.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
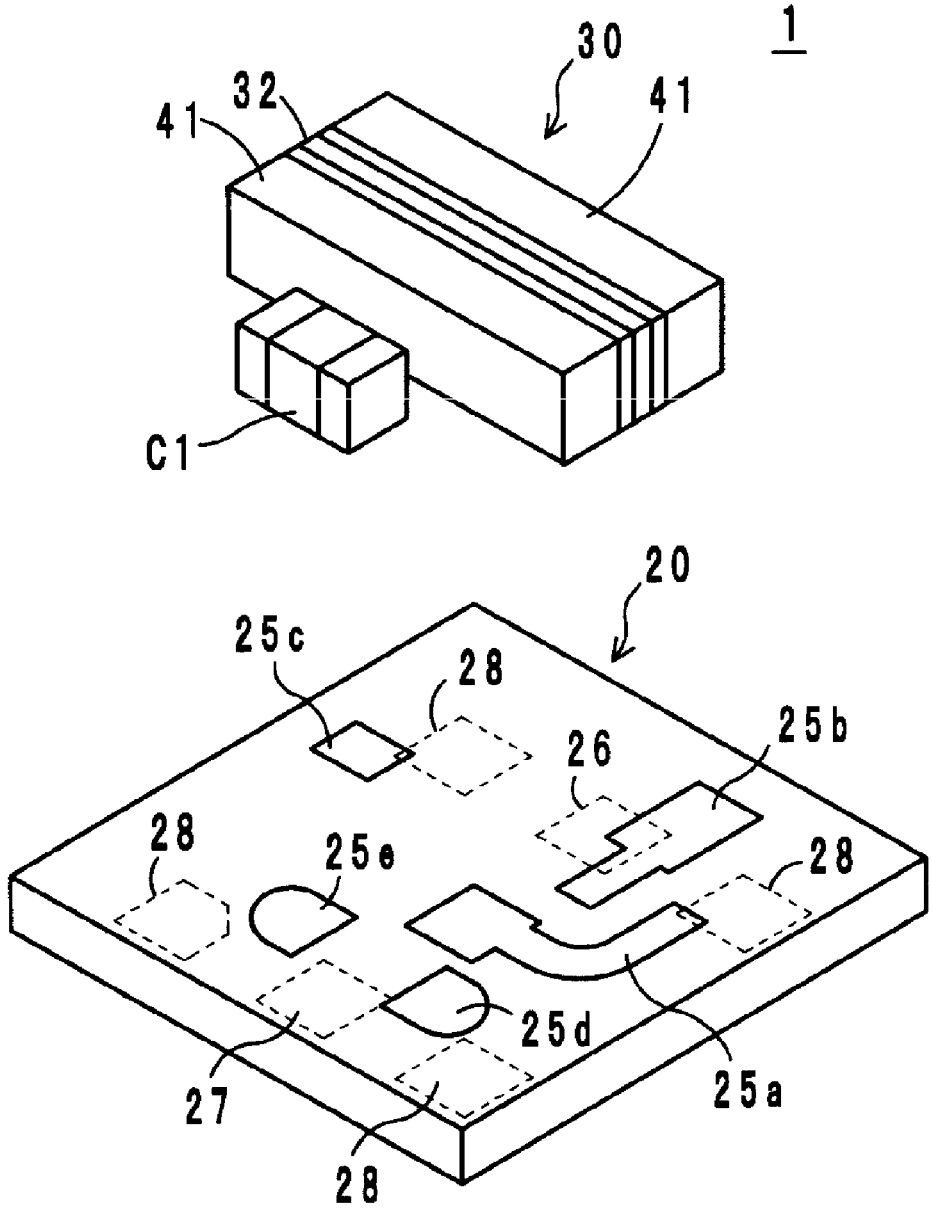
FIG. 1 is an exploded perspective view of a nonreciprocal circuit device (2-port isolator) according to a first preferred embodiment of the present invention.

Hereinafter, preferred embodiments of a ferrite magnet device, a nonreciprocal circuit device, and a composite electronic component according to the present invention will be described with reference to the attached drawings. Note that in the preferred embodiments common components and portions are denoted with the same reference numerals, and duplicate descriptions thereof are omitted.

First Preferred Embodiment

A first preferred embodiment of the present invention will be described with reference to FIGS. 1 to 5. FIG. 1 shows an exploded perspective view of a 2-port isolator 1 according to the first preferred embodiment. The 2-port isolator 1 is a lumped-parameter isolator, and includes a circuit substrate 20, a ferrite magnet device 30 having a ferrite element 32 and a pair of permanent magnets 41, and matching circuit devices, for example, a capacitor C1 is mounted on the circuit substrate 20, and other devices are provided in the circuit substrate 20.

Figure 2:
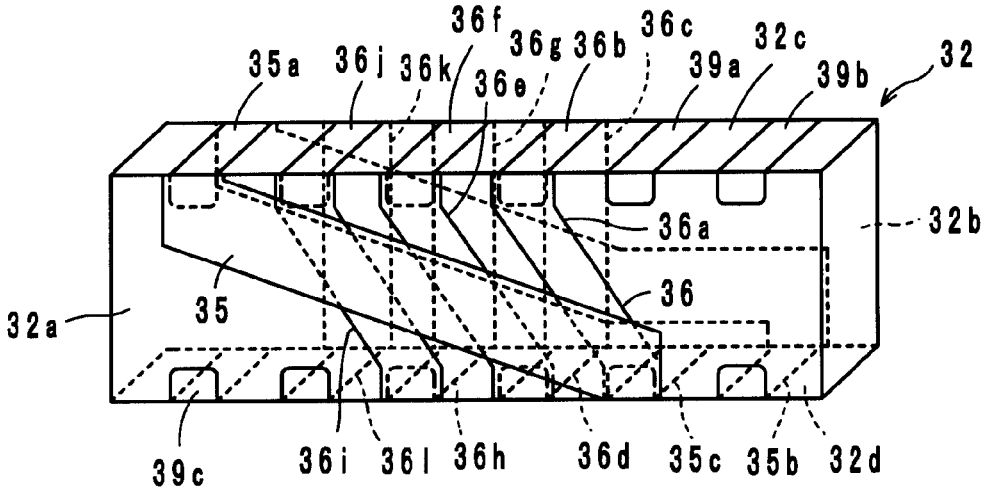
FIG. 2 is a perspective view of a ferrite element having central electrodes disposed thereon.
Figure 3:
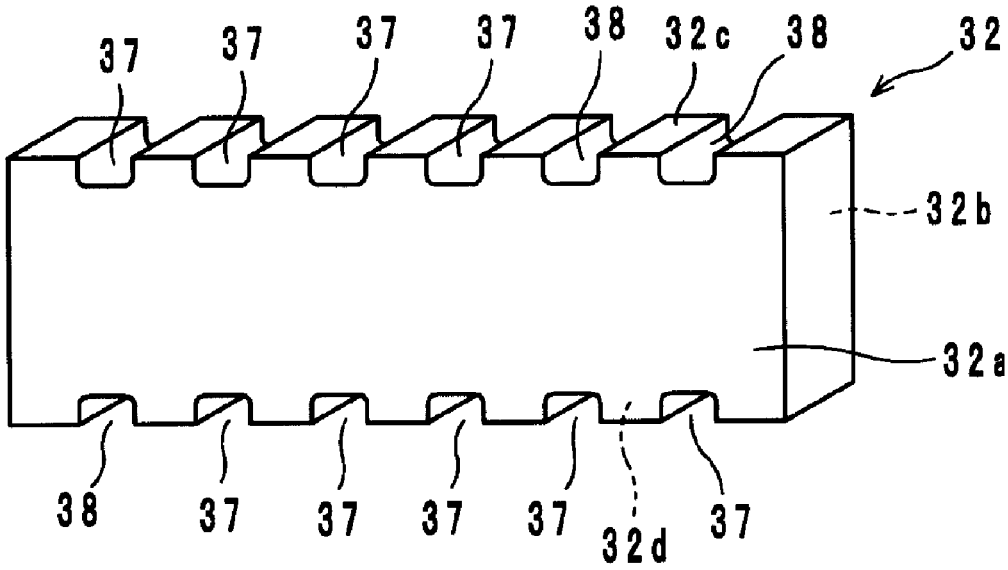
FIG. 3 is a perspective view of the ferrite element.

Referring to FIG. 2, the ferrite element 32 includes a first central electrode 35 and a second central electrode 36 electrically isolated from one another and arranged on a front main surface 32*a* and a back main surface 32*b* thereof. Here, the ferrite element 32 has a substantially rectangular parallelepiped shape in which the main surface 32*a* and the opposite back main surface 32*b* arranged substantially in parallel.

The permanent magnets 41 are bonded to the main surfaces 32*a* and 32*b* preferably using, for example, epoxy adhesive layers 42 (see FIG. 4) so as to apply a DC magnetic field, which is substantially perpendicular to the main surfaces 32*a* and 32*b*, to the ferrite element 32, thereby defining the ferrite magnet device 30. The main surfaces of the permanent magnets 41 have substantially the same dimensions as those of the main surfaces 32*a* and 32*b* of the ferrite element 32, and are arranged such that the surfaces face each other so as to be substantially aligned. The method of manufacturing the ferrite magnet device 30 will be described in detail later with reference to FIGS. 6 to 8.

The first central electrode 35 is made of a metal foil, for example, a copper (Cu) foil) as described below. Referring to FIG. 2, the first central electrode 35 is preferably arranged on the first main surface 32*a* of the ferrite element 32, starting at the bottom right and extending upward toward the top left with a relatively small inclination angle relative to the long side, and then extends through a relay electrode 35*a* disposed on an upper surface 32*c* to the second main surface 32*b*, where it is arranged in the same or substantially the same manner as on the first main surface 32*a*, so as to provide a mirror image of the electrode on the first main surface 32*a*. One end of the first central electrode 35 is connected to an electrode 35*b* disposed on a lower surface 32*d*, and the other end is connected to an electrode 35*c* disposed on the lower surface 32*d*. Thus, the first central electrode 35 is wound around the ferrite element 32 by approximately one turn. The first central electrode 35 and the second central electrode 36 described below intersect each other in an insulated state with an insulator layer 43 disposed therebetween (see FIG. 4). The angle with which the central electrodes 35 and 36 intersect is appropriately set so as to adjust the input impedance and insertion loss.

The second central electrode 36 is made of a metal foil (for example, a Cu foil). The second central electrode 36 is configured such that the first half of a first turn, i.e., a half turn (#0.5) 36*a*, is disposed on the first main surface 32*a*, starting at the bottom right and extending upward toward the top left with a relatively large inclination angle relative to the long side while intersecting with the first central electrode 35, and then extends through an electrode 36*b* disposed on the upper surface 32*c* to the second main surface 32*b*. On the second main surface 32*b*, the second half of the first turn, i.e., a half turn (#1) 36*c*, is arranged in a substantially vertical direction while intersecting with the first central electrode 35. The bottom portion of the half turn (#1) 36*c* extends through an electrode 36*d* disposed on the lower surface 32*d* to the first main surface 32*a*. On the first main surface 32*a*, the first half of a second turn, i.e., a half turn (#1.5) 36*e*, is arranged substantially in parallel with the half turn (#0.5) 36*a* while intersecting with the first central electrode 35, and extends through an electrode 36*f* disposed on the upper surface 32*c* to the second main surface 32*b*. Likewise, a half turn (#2) 36*g*, an electrode 36*h*, a half turn (#2.5) 36*i*, an electrode 36*j*, a half turn (#3) 36*k*, and an electrode 36*l* are arranged on the surfaces of the ferrite element 32. Ends of the second central electrode 36 are respectively connected to the electrode 35*c* and an electrode 36*l* disposed on the lower surface 32*d* of the ferrite element 32. Note that the electrode 35*c* is used as a common connection electrode to connect one end of the first central electrode 35 and a corresponding end of the second central electrode 36.

The electrodes 35*a*, 35*b*, 35*c*, 36*b*, 36*d*, 36*f*, 36*h*, 36*j*, and 36*l* are preferably disposed in depressions 37 (see FIG. 3) of the upper surface 32*c* and the lower surface 32*d* of the ferrite element 32, using Ag or Cu plating, for example. The upper surface 32*c* and the lower surface 32*d* of the ferrite element 32 also have dummy depressions 38 provided thereon that are substantially in parallel with the depressions 37, and dummy electrodes 39*a*, 39*b*, and 39*c* disposed in the dummy depressions 38. These electrodes are preferably formed by providing through holes in a ferrite mother substrate, plating the through holes with electrode metal, and cutting the mother substrate such that the through holes are cut in half.

Figure 4:
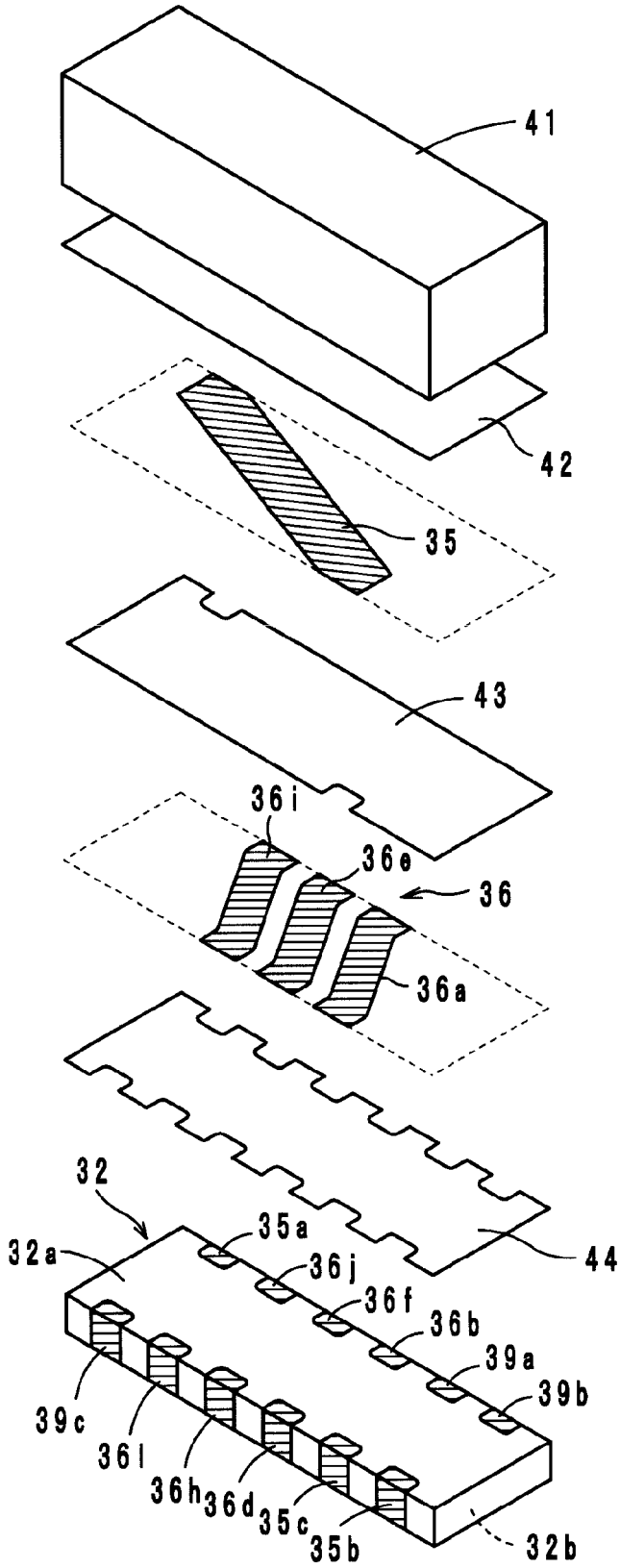
FIG. 4 is an exploded perspective view of a ferrite magnet device.

FIG. 4 shows how each of the elements is stacked on the first main surface 32*a* of the ferrite element 32. On the first main surface 32*a*, the second central electrode 36 is stacked, with an adhesive layer 44 therebetween, and then the first central electrode 35 is stacked on the second central electrode 36, with the insulator layer 43 therebetween. Finally, the permanent magnet 41 is bonded to the first central electrode 35, with the adhesive layer 42 therebetween. Likewise, the layers described above are stacked (not shown in FIG. 4) on the second main surface 32*b* of the ferrite element 32. Note that the manufacturing method will be described later, referring to FIGS. 6 to 8.

For the ferrite element 32, yttrium iron garnet (YIG) ferrite, for example, is preferably used. The first and second central electrodes 35 and 36 are preferably formed by etching a Cu metal foil, for example. A resin film made of, for example, polyimide may preferably be used for the insulator layer 43 between the first central electrode 35 and the second central electrode 36. This film may preferably be formed by printing, transcription, photolithography, for example.

A strontium, barium, or lanthanum-cobalt ferrite magnet, for example, is typically used for the permanent magnets 41. Single-liquid thermoset epoxy adhesive, for example, is preferably used for the adhesive layer 42 that bonds the permanent magnets 41 and the ferrite element 32.

Figure 5:
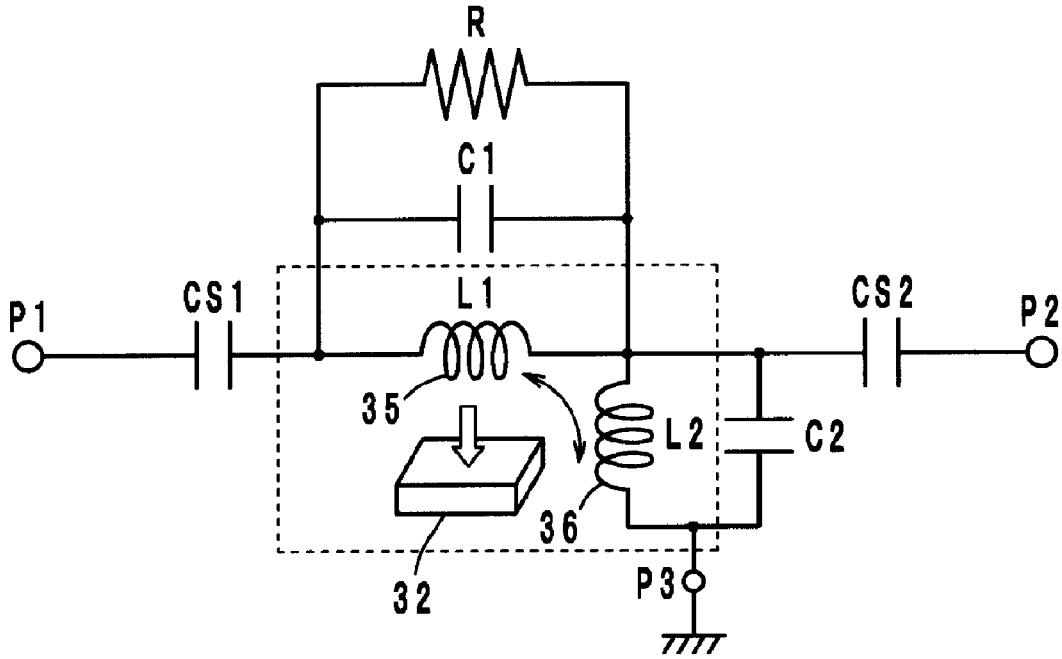
FIG. 5 is an equivalent circuit diagram of a circuit of the 2-port isolator.

The circuit substrate 20 is preferably a low temperature co-fired ceramic (LTCC) substrate, for example, and the following is formed on the surface thereof: terminal electrodes 25*a*, 25*b*, 25*c*, 25*d*, and 25*e* arranged to mount the ferrite magnet device 30 and the capacitor C1, which is chip-shaped and one of the matching circuit devices, input/output electrodes 26 and 27, and a ground electrode 28. Referring to FIG. 5, the matching circuit devices, i.e., capacitors C2, CS1, and CS2, and a resistor R, described later are provided as internal components in the circuit substrate 20, and these devices define a predetermined circuit preferably using via-hole conductors.

The ferrite magnet device 30 is mounted on and combined with the circuit substrate 20. The electrodes 35*b*, 35*c*, and 36*l* on the lower surface 32*d* of the ferrite element 32 are respectively reflow soldered and fixed to the terminal electrodes 25*a*, 25*b*, and 25*c* on the circuit substrate 20. The capacitor C1 is reflow soldered to the terminal electrodes 25*d* and 25*e* on the circuit substrate 20.

Circuit Configuration

FIG. 5 shows the equivalent circuit of the 2-port isolator 1. An input port P1 is connected to the matching capacitor C1 and the terminating resistor R via the matching capacitor CS1, which is connected to one end of the first central electrode 35. The other end of the first central electrode 35 and one end of the second central electrode 36 are connected to the terminating resistor R and the capacitors C1 and C2, and also connected to an output port P2 via the capacitor CS2. The other end of the second central electrode 36 and the capacitor C2 are connected to a ground port P3.

In the 2-port isolator 1 having the equivalent circuit described above, one end of the first central electrode 35 is connected to the input port P1 and the other end is connected to the output port P2, and one end of the second central electrode 36 is connected to the output port P2 and the other end is connected to the ground port P3. Thus, a 2-port lumped-parameter isolator having a low insertion loss is provided. Furthermore, a large high-frequency current flows in the second central electrode 36, whereas almost no high-frequency current flows in the first central electrode 35 during operation.

Since the ferrite magnet device 30 has a structure in which the ferrite element 32 and the pair of the permanent magnets 41 are combined, the ferrite magnet device 30 is mechanically stable and provides a sturdy isolator that will not be deformed or damaged by vibration or shock.

Manufacturing Process

Figure 6:
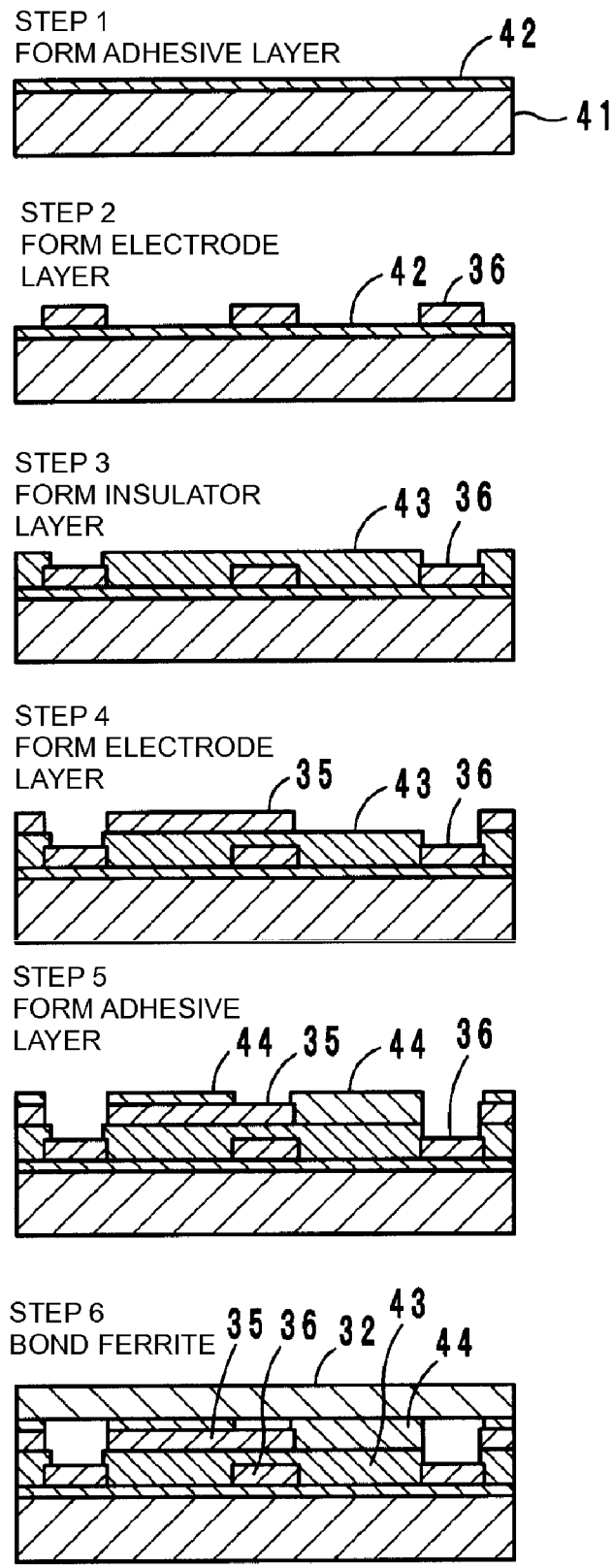
FIG. 6 is a diagram of a process for manufacturing a ferrite magnet device.
Figure 7:
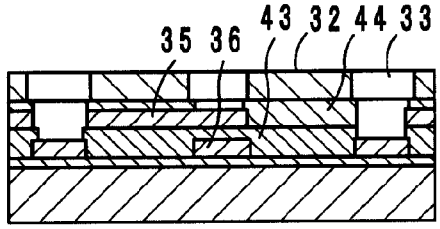
FIG. 7 is a diagram of the process of manufacturing the ferrite magnet device continued from FIG. 6.
Figure 7:
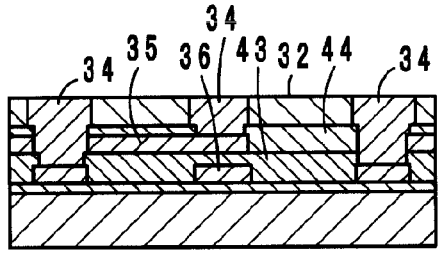
Figure 7:
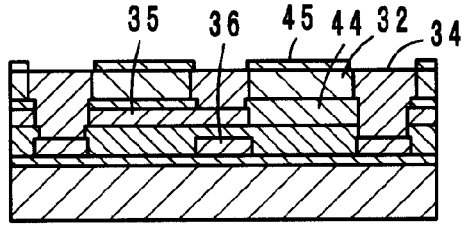
Figure 7:
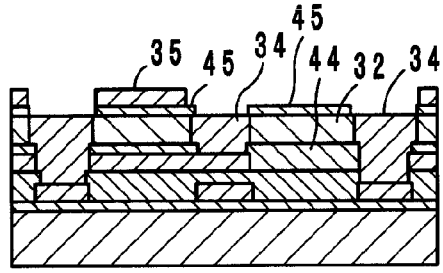
Figure 7:
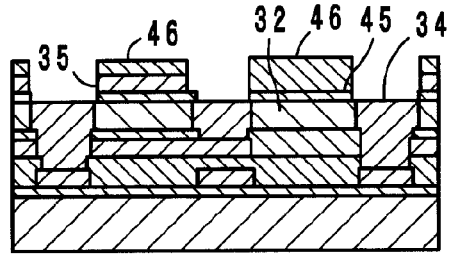
Figure 8:
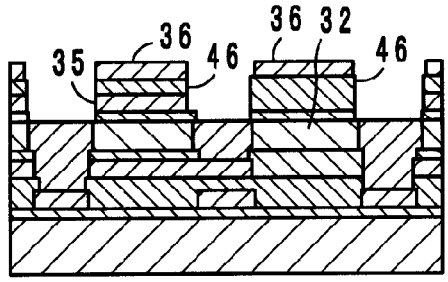
FIG. 8 is a diagram of the process for manufacturing the ferrite magnet device continued from FIG. 7.
Figure 8:
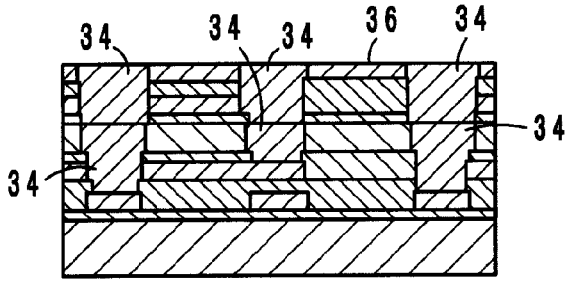
Figure 8:
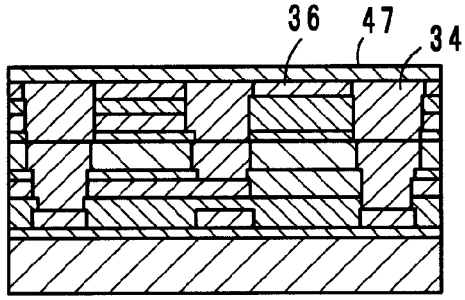
Figure 8:
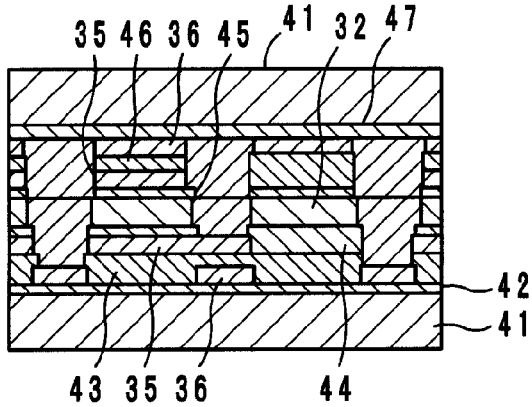

Referring to FIGS. 6 to 8, the manufacturing process of the ferrite magnet device 30 will be described. Note that sectional views of a portion of the ferrite magnet device 30 are shown in FIGS. 6 to 8.

The ferrite element 32 is manufactured as follows. Preferably, microwave magnetic powder composed primarily of yttrium oxide and iron oxide is dispersed in an organic solvent together with a polyvinyl alcohol organic binder, for example, to obtain slurry. Then the slurry of the microwave magnetic powder is molded using, for example, dry pressing and fired at a temperature of about 1300° C. to about 1400° C. Note that magnetic powder, such as manganese magnesium ferrite, nickel zinc ferrite, and calcium vanadium garnet, for example, may preferably be used instead of the main composite described above.

The first central electrode 35 and the second central electrode 36 may be formed in any order. In the example shown in FIGS. 2 and 4, the second central electrode 36 is formed in a portion that is more central than the first central electrode 35. However, the manufacturing process will be described using an example in which the first central electrode 35 is formed in a portion that is more central than the second central electrode 36.

In step 1, the adhesive layer 42 is formed on the main surface of the permanent magnet 41. In step 2, a metal foil is bonded onto the adhesive layer 42 and an electrode layer defining the second central electrode 36 is formed using photolithography, for example. A marker, which defines a position reference for stacking is also formed in step 2. In step 3, the insulator layer 43 is formed. In step 4, a metal foil is bonded onto the insulator layer 43, and an electrode layer defining the first central electrode 35 is formed preferably using photolithography, for example. In step 5, the adhesive layer 44 is formed. In step 6, the ferrite element 32 is bonded onto the adhesive layer 44.

In step 7, through holes 33, which correspond to the depressions 37 and 38 of the upper and lower surfaces, are formed. A laser, for example, is preferably used to form the through holes 33, but a sandblaster may be used instead. In step 8, electrodes 34 are formed in the through holes 33 preferably using plating, for example. The electrodes 34 are also formed in portions in which the adhesive layer 44 and the insulator layer 43 have not been formed, and connect the first central electrode 35 and the second central electrode 36 on the upper surface 32*c* and the lower surface 32*d* of the ferrite element 32. In step 9, an adhesive layer 45 is formed on the main surface of the ferrite element 32. In step 10, a metal foil is bonded onto the adhesive layer 45 and an electrode layer defining the first central electrode 35 is formed preferably using photolithography, for example. In step 11, an insulator layer 46 is formed. In steps 9 and 11, aperture portions are formed above the electrodes 34 preferably using lithography, for example.

In step 12, a metal foil is bonded onto the insulator layer 46, and an electrode layer defining the second central electrode 36 is formed preferably using photolithography, for example. In step 13, additional portions of the electrodes 34 are formed preferably using plating, for example. The additional portions of the electrodes 34 that are formed are connected to the central electrodes 35 and 36, and are also connected to the original portions of the electrodes 34 formed in step 8. In step 14, an adhesive layer 47 is formed. In step 15, another permanent magnet 41 is bonded onto the adhesive layer 47.

The manufacturing method described above employs a multiple-production method. In other words, a mother magnet substrate and a mother ferrite substrate are respectively used for the permanent magnet 41 and the ferrite element 32, and the predetermined layers are stacked to configure one unit of a plurality of the ferrite magnet devices 30 on their surfaces, and undergo appropriate shaping processes. After step 15, the mother substrates are cut into a predetermined size.

Figure 9:
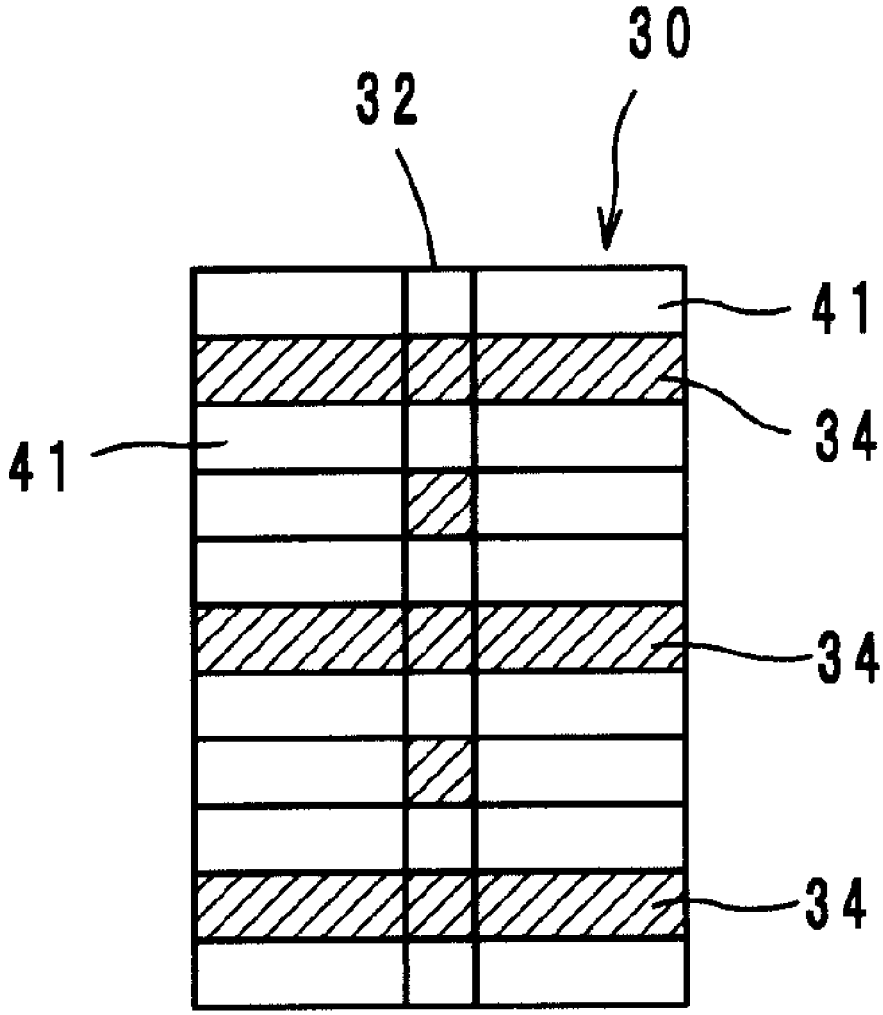
FIG. 9 is a bottom view of a ferrite magnet device having through holes and electrodes provided on the lower surface of a permanent magnet.

In the manufacturing method described above, without forming portions of the electrodes 34 in step 8, the entire electrodes 34 may preferably be formed in step 13. Alternatively, by forming the through holes 33 at any time in steps 9 to 13, without forming them in step 7 (and also without performing step 8 in this case), the entire electrodes 34 may preferably be formed in step 13. Furthermore, after steps 2 and 15, the electrodes 34 may be formed by also forming through holes on the lower surfaces (surfaces to be mounted on the circuit substrate 20) of the permanent magnets 41, and then by plating the through holes. FIG. 9 shows the lower surface of the ferrite magnet device 30 manufactured in this manner. By also forming the electrodes 34 on the lower surfaces of the permanent magnets 41, the soldering strength is increased when the ferrite magnet device 30 is mounted on the circuit substrate 20.

In the manufacturing method described above, manufacturing can be performed by stacking, on the main surface of the permanent magnet 41, the adhesive layer 42, a metal foil defining the second central electrode 36, the insulator layer 43, a metal foil defining the first central electrode 35, the adhesive layer 44, the ferrite element 32, the adhesive layer 45, a metal foil defining the first central electrode 35, the insulator layer 46, a metal foil defining the second central electrode 36, the adhesive layer 47, and the permanent magnet 41, in this sequence. Since only one position reference is required for the stacking, precision is greatly improved. Furthermore, since the central electrodes 35 and 36 are formed of metal foils and the electrodes 34 (35*a*, 35*b*, 35*c*, 36*b*, 36*d*, 36*f*, 36*h*, 36*j*, and 36*l*) are formed by plating, no sintering is required, and thus, no shrinkage error caused by sintering occurs.

Second Preferred Embodiment

Figure 10:
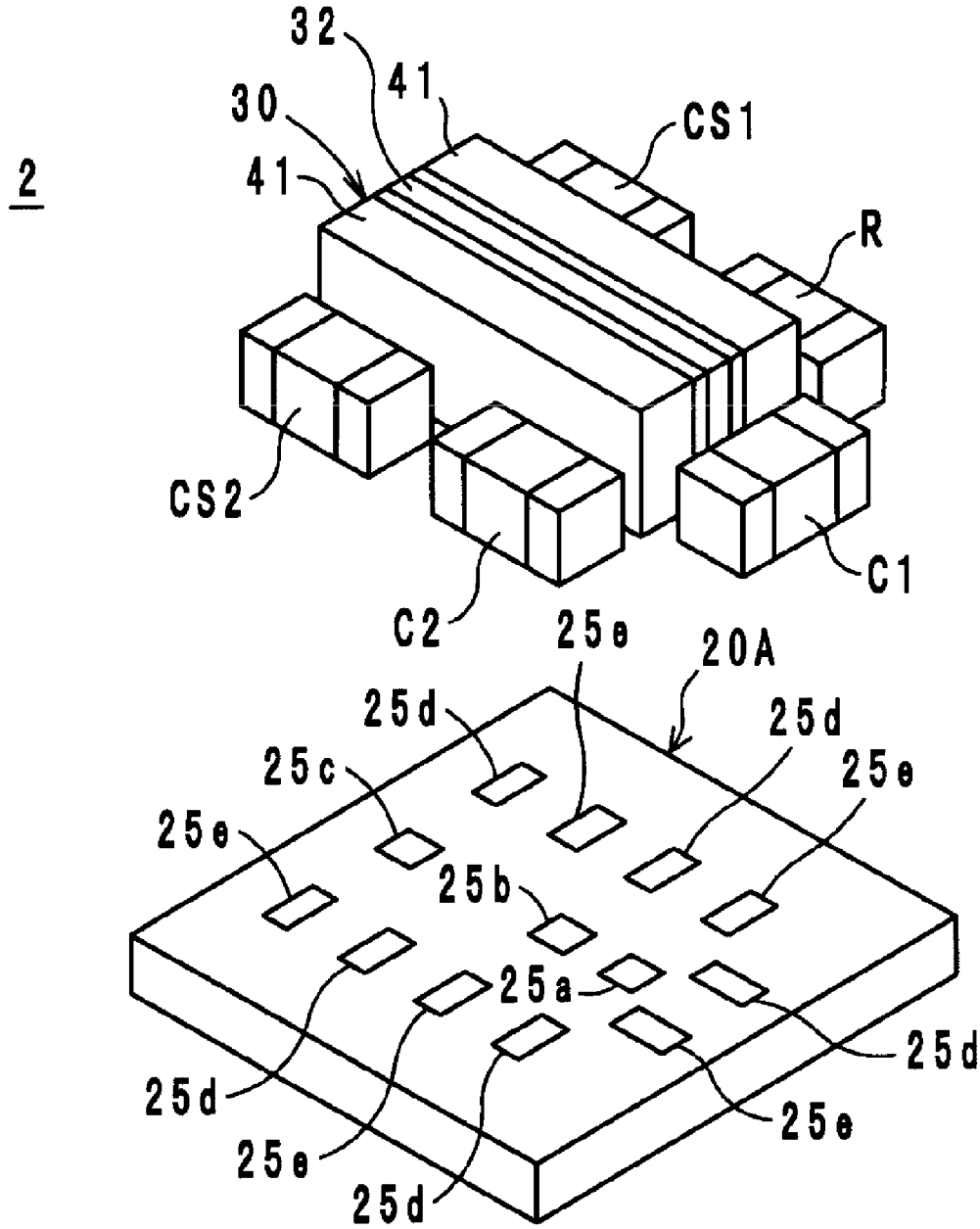
FIG. 10 is an exploded perspective view of a nonreciprocal circuit device (2-port isolator) according to a second preferred embodiment of the present invention.

A second preferred embodiment of the present invention will be described with reference to FIG. 10. FIG. 10 shows an exploded perspective view of a 2-port isolator 2 according to the second preferred embodiment. The 2-port isolator 2 has substantially the same structure as the first preferred embodiment except that all of the matching circuit devices C1, C2, CS1, CS2, and R are chip devices and are soldered to the surface of a printed circuit board 20A. In addition to the terminal electrodes 25*a*, 25*b*, and 25*c* arranged to connect both ends of the first and second central electrodes 35 and 36, the terminal electrodes 25*d* and 25*e* arranged to be connected to corresponding matching circuit devices are preferably provided on the surface of the printed circuit board 20A. Input and output electrodes and a ground electrode are also provided, although not shown.

Third Preferred Embodiment

Figure 11:
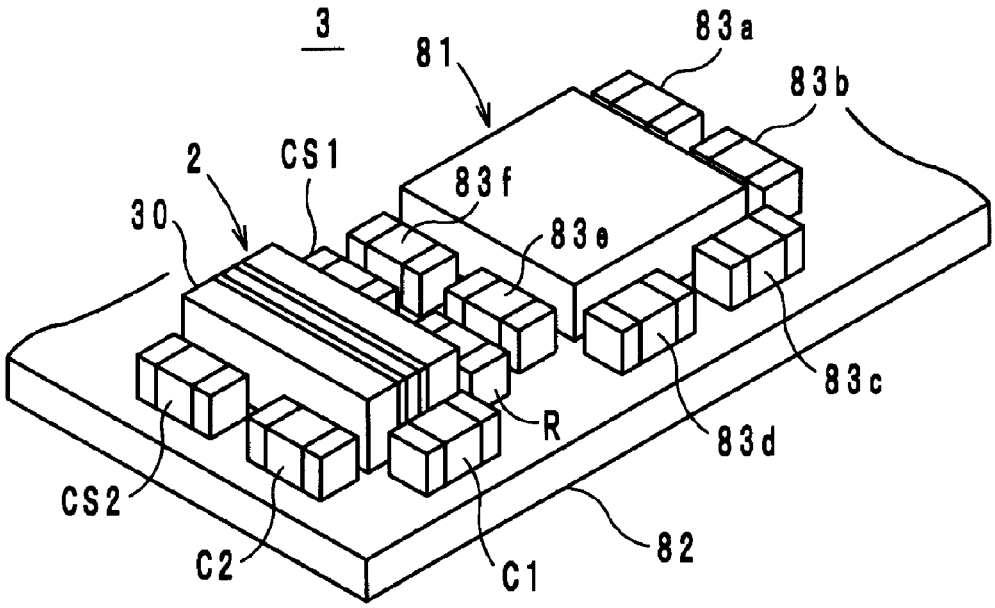
FIG. 11 is a perspective view of a composite electronic component according to a third preferred embodiment of the present invention.

A third preferred embodiment of the present invention will be described with reference to FIGS. 11 and 12. FIG. 11 shows a composite electronic component 3 according to the third preferred embodiment. The composite electronic component 3 is a module configured by mounting the 2-port isolator 2 and a power amplifier 81 on the surface of a printed circuit board 82. Necessary chip circuit devices 83*a* to 83*f* are also mounted around the power amplifier 81.

Figure 12:
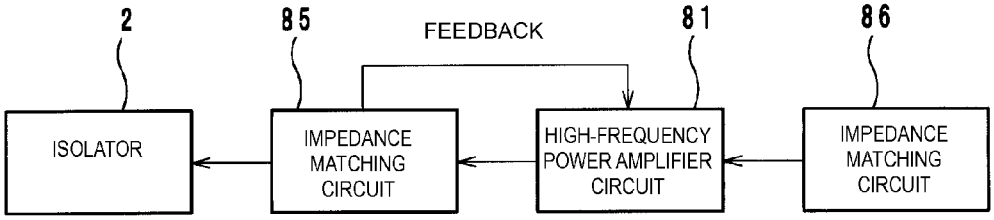
FIG. 12 is a block diagram of a circuit configuration of the composite electronic component.

FIG. 12 shows a circuit configuration of the composite electronic component 3. The output of an impedance matching circuit 86 is input to the high-frequency power amplifier 81, whose output is input to the 2-port isolator 2 via an impedance matching circuit 85.

Fourth Preferred Embodiment

Figure 13:
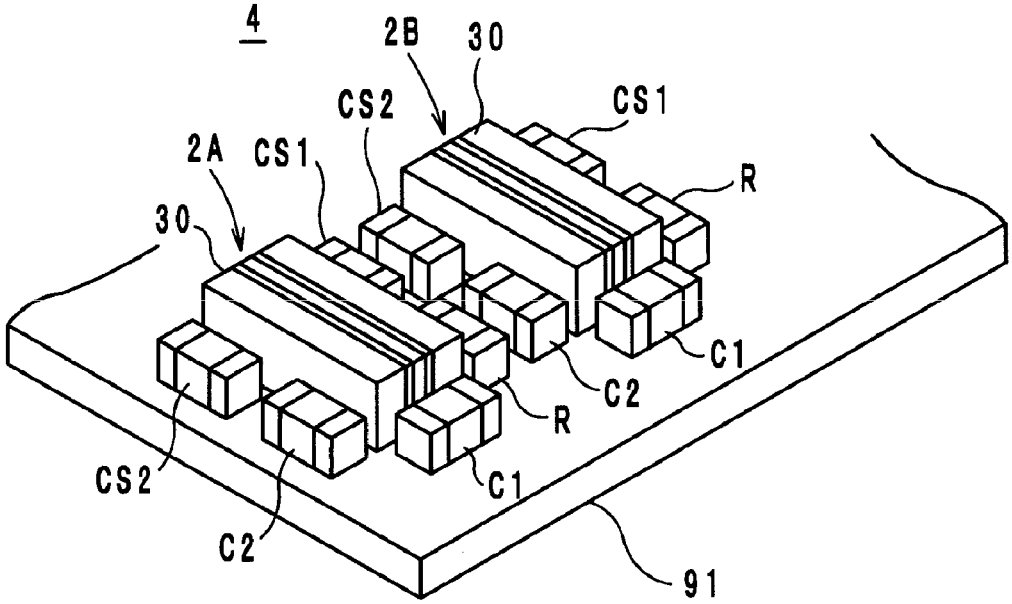
FIG. 13 is a perspective view of a composite electronic component according to a fourth preferred embodiment of the present preferred embodiment.

A fourth preferred embodiment of the present invention will be described with reference to FIG. 13. FIG. 13 shows a composite electronic component 4 according to the fourth preferred embodiment. The composite electronic component 4 is a module configured by mounting isolators 2A and 2B on the surface of a printed circuit board 91. The isolators 2A and 2B each have a structure similar to that of the 2-port isolator 2, and the isolator 2A is preferably used for an 800 MHz band, for example, and the isolator 2B is preferably used for a 2 GHz band, for example.

Fifth Preferred Embodiment

Figure 14:
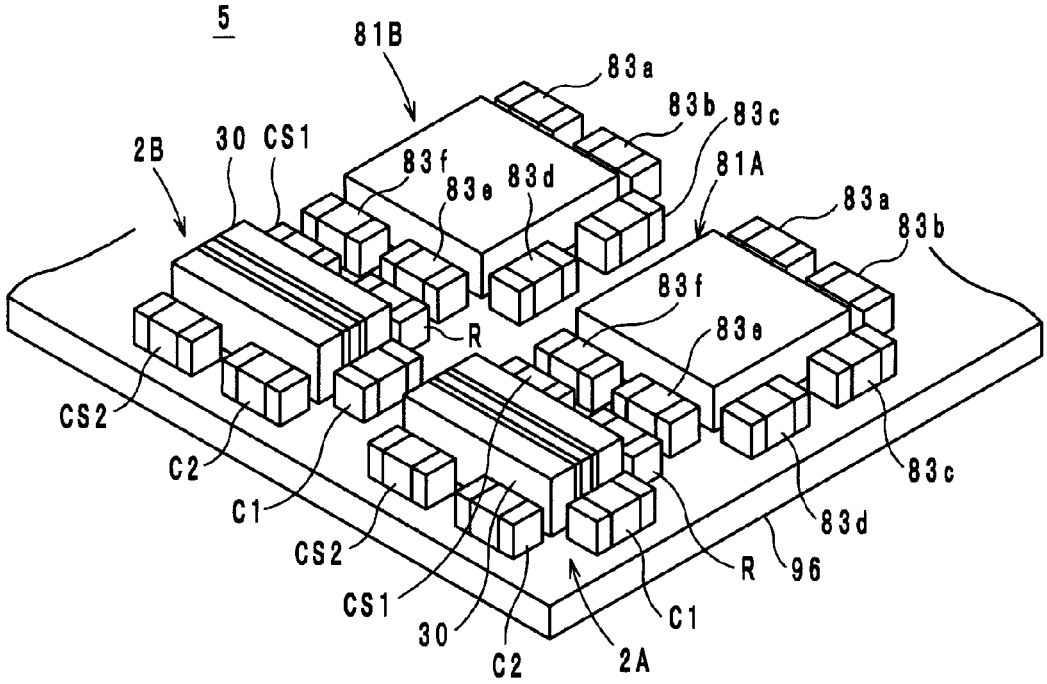
FIG. 14 is a perspective view of a composite electronic component according to a fifth preferred embodiment of the present invention.

A fifth preferred embodiment of the present invention will be described with reference to FIG. 14. FIG. 14 shows a composite electronic component 5 according to the fifth preferred embodiment. The composite electronic component 5 is a module configured by mounting a set of the isolator 2A and a power amplifier 81A and a set of the isolator 2B and a power amplifier 81B on the surface of a printed circuit board 96.

A ferrite magnet device, a nonreciprocal circuit device, and a composite electronic component according to the present invention are not limited to the preferred embodiments described above, and various modifications are possible within the scope of the present invention.

Specifically, any suitable configuration of the matching circuit may be used. Example methods of bonding a ferrite magnet device and matching circuit devices onto the surface of a substrate include bonding with conductive adhesive, ultra sonic bonding, and bridge bonding, in addition to the soldering used in the preferred embodiments described above. A ferrite magnet device may be a device in which a permanent magnet is bonded to only one of the main surfaces of a ferrite element.

While preferred embodiments of the present invention have been described above, it is to be understood that variations and modifications will be apparent to those skilled in the art without departing from the scope and spirit of the invention. The scope of the invention, therefore, is to be determined solely by the following claims.

What is claimed is:

1. A ferrite magnet device comprising:

a ferrite element having a plurality of central electrodes arranged to intersect one another in an electrically insulated state; and a permanent magnet fixed to a main surface of the ferrite element so as to apply a direct current magnetic field to the ferrite element; wherein the central electrodes are made of metal foils that are provided on both main surfaces of the ferrite element with adhesive layers therebetween, and each of the central electrodes is arranged to conduct electricity through a corresponding plated electrode provided on a surface of the ferrite element that is perpendicular or substantially perpendicular to at least one of the main surfaces of the ferrite element;

the plated electrode is made of an unsintered material and by a plating method;

another plated electrode is provided on a mounting surface of the permanent magnet; and the another plated electrode is disposed in a through hole provided on the mounting surface of the permanent magnet.

2. The ferrite magnet device according to claim 1, wherein the plated electrode is disposed in a through hole provided on the surface of the ferrite element perpendicular or substantially perpendicular to the at least one of the main surfaces of the ferrite element.

3. The ferrite magnet device according to claim 1, wherein the metal foils are made of copper.

4. A nonreciprocal circuit device comprising the ferrite magnet device according to claim 1.

5. A composite electronic component comprising the nonreciprocal circuit device according to claim 4.

* * * * *